United States Patent [19]

Taft et al.

[11] 4,441,526

[45] Apr. 10, 1984

[54] ANALOG ELECTRO-FLUIDIC SIGNAL TRANSDUCER

[76] Inventors: Charles K. Taft, 25 Woodridge Rd., Durham, N.H. 03824; Benjamin M. Herrick, 23 Davis Rd., Apt. C3, Acton, Mass. 01720

[21] Appl. No.: 322,004

[22] Filed: Nov. 16, 1981

[51] Int. Cl.[3] ..... F15C 1/04; F15C 1/14; F15C 1/06

[52] U.S. Cl. ..... 137/831; 137/822; 137/833

[58] Field of Search ..... 137/822, 831, 833

[56] References Cited

U.S. PATENT DOCUMENTS 3,451,412 6/1969 Render ..... 137/831
3,565,090 2/1971 Miller ..... 137/831
3,638,671 2/1972 Harvey et al. ..... 137/831
3,965,918 6/1976 Finkbeiner et al. ..... 137/831

*Primary Examiner*—A. Michael Chambers
*Attorney, Agent, or Firm*—Kenway & Jenney

[57] ABSTRACT

An analog electro-fluidic signal transducer utilizing one or a tandem series of laminar proportional amplifiers. The transducer has input passages at a varying pressure differential produced by movements of a piezoelectric bender bimorph between opposed nozzles in a pressurized chamber. The pressure in the chamber and the excursion of the bender between the nozzles relative to the nozzle diameters are limited to minimize turbulence and achieve a pressure differential between the input passages that varies proportionally to or as an analog of a voltage applied to the bender. The pressure differential between the input passages is amplified by the amplifier or plural amplifiers in tandem series.

10 Claims, 6 Drawing Figures

ANALOG ELECTRO-FLUIDIC SIGNAL TRANSDUCER

SUMMARY OF THE INVENTION

This invention relates generally to an analog signal transducer for producing a fluid pressure differential that varies proportionally or as an analog of an applied electrical voltage. Typically, the output of the transducer is used as the input to a pneumatic or other fluidic control of the type offering a high power output, fast response and economical control.

There have been rapid developments recently in systems having complex electrical signal processing capabilities. Particularly with the use of semi-conductors, the cost of such systems has been substantially reduced. In order to take advantage of the electrical signal processing which is now available, interface transducers between electrical signals and pneumatic signals are needed. At the present time there is very little hardware available to perform this process. The proportional electro-pneumatic converters that have been developed have tended to be quite slow and expensive. There is a need for a low cost, high speed converter having low electrical power consumption, and which can take advantage of the benefits of low cost and reliability that are obtainable with an electro-pneumatic control system.

To illustrate, a presently available integrated circuit may be considered, for example a circuit of the type adapted to convert signal information from digital to analog form, and which may produce an analog output voltage varying to plus or minus 15 volts. A transducer is desired to convert this signal to a corresponding fluidic pressure differential sufficiently large to operate a pneumatic or other fluidic control system. It is desirable that the transducer shall operate with a minimal consumption of electrical power from the circuit, that it will have a fast response to variations in the supplied voltage, that it will have a high gain and bandwidth, and that it will introduce a minimum of "noise" in the signal conversion, that is, spurious excursions in the output pressure differential that are introduced by the transducer and are not derived from the voltage applied.

With the foregoing and other objects hereinafter appearing in view, the features of this invention include the use of a piezoelectric bimorph bender element excited by an applied analog electrical signal to flex between a pair of opposed nozzles in a pressurized chamber. This generates in input passages connected with the nozzles a small fluidic pressure differential that varies proportionally or as an analog of the applied electrical signal. The pressure within the chamber, as well as the dimensions of these elements, are limited to maintain the transducer in an analog mode with the capability of a DC output. The small pressure differential so obtained is then amplified to a usable level by one or a series of laminar proportional amplifiers.

DETAILED DESCRIPTION

Figure 1:
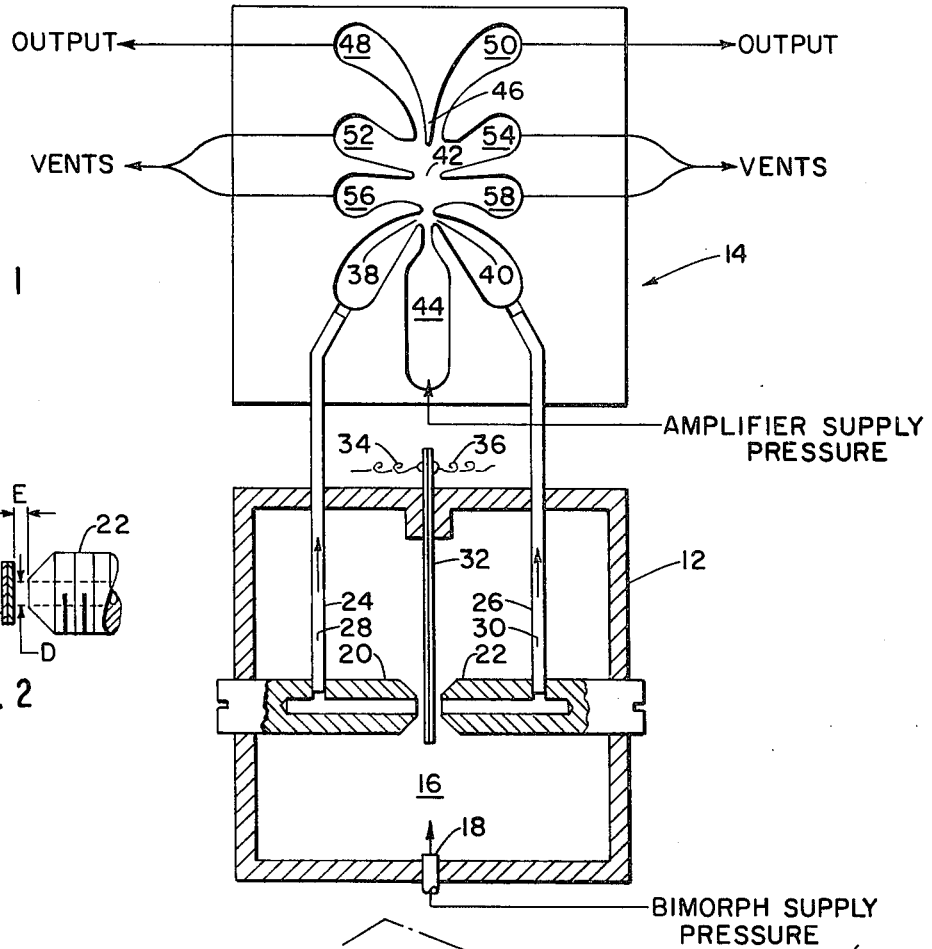
FIG. 1 is a schematic diagram illustrating features of the invention.

FIG. 1 is an illustrative schematic diagram showing a housing 12 and a laminar proportional amplifier 14. The housing 12 defines a first chamber 16 having means 18 for connection to a first source of controlled, low level fluid pressure, for example air pressure. A pair of mutually opposed nozzles 20 and 22 are mounted in the housing and have internal passages connected with ducts 24 and 26 defining input passages 28 and 30. An elongate, generally rectangular piezoelectric bimorph element 32 is cantilever mounted in the chamber so that a portion is located equidistant between the nozzles when unexcited by an electrical voltage. The element 32 typically comprises a central brass shim with a piezoceramic layer of a material such as barium titanate on each side of it, the exterior surfaces of these layers being nickel plated. Leads 34 and 36 are connected to the respective nickel surfaces from a suitable electrical circuit such as the analog output of an integrated semiconductor circuit of known type.

The input passages 28 and 30 are connected to inlets 38 and 40 of the laminar proportional amplifier 14. This amplifier is of a known type and has a chamber 42 and a passage 44, the latter being adapted for connection to a second source of fluid pressure and for directing a laminar jet of fluid, for example air, into the chamber 42. The inlets 38 and 40 are located on opposing sides of the emerging jet. A flow divider 46 is located in the path of the jet downstream of the inlets 38 and 40, and separates a pair of output passages 48 and 50 diverging therefrom.

In operation, the pressures in the input passages 28 and 30, respectively, depend on the location of the bender element 32 relative to the nozzles 20 and 22. The pressure difference in the passages is applied across the inlets 38 and 40 and deflects the laminar jet, thereby varying the division of the jet stream between the output passages 48 and 50. The operation of laminar proportional amplifiers of this type is in itself well known. Typically, the pressure differential between the output passages 48 and 50 exceeds the pressure differential between the inlets 38 and 40 by a substantial amount. The gain achieved is a function of several well-known factors including the load applied to the output passages and the distance between the flow divider 46 and the inlets 38 and 40. Gains of up to about 10 may be given for purposes of illustration.

Figure 2:
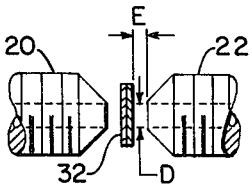
FIG. 2 is a fragmentary view showing the portion of the piezoelectric bender between the nozzles.

In order that the transducer wil operate as a proportional or analog converter, it is important to choose and maintain appropriate dimensional relationships and pressure conditions within the chamber 16. Referring to FIG. 2, D represents the diameter of the internal passage in each of the nozzles 20 and 22 and E represents the distance from each nozzle to the adjacent surface of the bender when the bender is unexcited. To maintain proportionality between the pressure difference in the passages 28 and 30 and the electrical potential difference applied to the bender 32, the maximum distance between the nozzle and the adjacent surface of the bender when the bender deflects away from the nozzle in response to the maximum applied voltage, is chosen to be less than about one-eighth of the nozzle diameter D. In practice, the diameter D is chosen to be 0.030 inch (0.76 mm) or larger in order to minimize clogging problems. The displacement of the bender in response to voltages of the order of 15 volts is relatively small, being only about plus or minus 0.0005 inch (0.013 mm). Thus, for a nozzle diameter of 0.76 mm and a maximum bender displacement of plus or minus 0.013 mm, the dimension E is no greater than 0.082 mm.

Piezoelectric bender elements have been used for some time in other unrelated types of devices. They are recongnized to have the advantage of a very low electrical power requirement. However, it has also been recognized that such elements are very poor force producers. This means that the pressure in the chamber 16 must be kept at a very low level, for static forces greatly reduce the beam deflection. Further, even at very low pressures the displacement of the beam is very small as indicated above for a voltage of plus or minus 15 volts compatible with present integrated circuits. In view of these considerations, it appears that piezoelectric benders have not been employed previously to this invention as electrofluidic converters for control purposes. We have discovered that by appropriately controlling the conditions and dimensions of the elements generating the pressures within the input passages 28 and 30 so as to satisfy the criteria for noise-free porportional or analog response, and by suitably amplifying the resulting very small output pressure differential by means of one or more laminar proportional amplifiers, sufficient gain can be achieved to provide a large enough pressure differential at the output passages 48 and 50 for practical applications. Such amplifiers are inherently characterized by high gain, high bandwidth and linearity of response.

It will be evident from the foregoing that, if desired, a plurality of laminar proportional amplifiers may be connected in a tandem series, with the output passages 48 and 50 being suitably connected to the inlets of a succeeding stage corresponding to the inlets 38 and 40 in the amplifier shown. The number of amplifier stages is a factor in determining the output signal level of the system.

If desired, a pneumatic to electric transducer can be connected between the output passages 48 and 50 of the illustrated amplifier 14, or the last stage of a series of tandem-connected amplifiers, and to the electrical amplifier controlling the bender 32. This provides for a feedback effect. The use of feedback around the entire system in this manner can help to reduce the small amount of hysteresis of the piezoelectric bender, and can reduce any noise or disturbances which might occur due to vent pressure variations in the laminar proportional amplifier.

In accordance with common practice in laminar proportional amplifiers, a plurality of vents 52, 54, 56 and 58 communicate with the chamber 42. Suitable connections are made externally of the amplifier 14 to connect these vents together so as to stabilize the vent pressure during operation in accordance with known practice.

FIGS. 3 to 6 are exploded views illustrating practical embodiments of the invention. A housing 60, which may be a solid block of plastic or metal, has a pair of orthogonally intersecting thru holes 62 and 64. Drill holes 66 and 68 defining the input passages communicate with the hole 62 at positions on opposite sides of the intersection between the holes 62 and 64. Nozzle elements 70 and 72 are threaded into the opposite ends of the hole 62. Details of the nozzle 70 are as follows, the nozzle 72 being connected in an identical manner. The nozzle 70 has a tapered end portion 74, and has an external thread with an annularly relieved central portion 76 that is located at the point of intersection of the holes 62 and 68 when assembled in the proper position. A partial bore 78 communicates between the portions 74 and 76, whereby the pressure within the bore 78 is communicated to the hole 68. Likewise, the pressure within a corresponding bore 80 in the nozzle 72 communicates with the hole 66.

A piezoelectric bender element 82 is cantilever mounted within the hole 64 at a suitable point remote from the intersection of the holes 62 and 64, with a portion 84 located between the nozzles 70 and 72. The relationship of the unexcited bender to the nozzles is the same as that illustrated in FIG. 2.

A connection 86 is provided for a first source of fluid pressure for pressurizing the chamber 88 that comprises the space surrounding the nozzles and the portion 84 of the piezoelectric bender. A connection 90 is provided for a second source of fluid pressure for producing the laminar jet in the proportional amplifier as described below.

Figure 4:
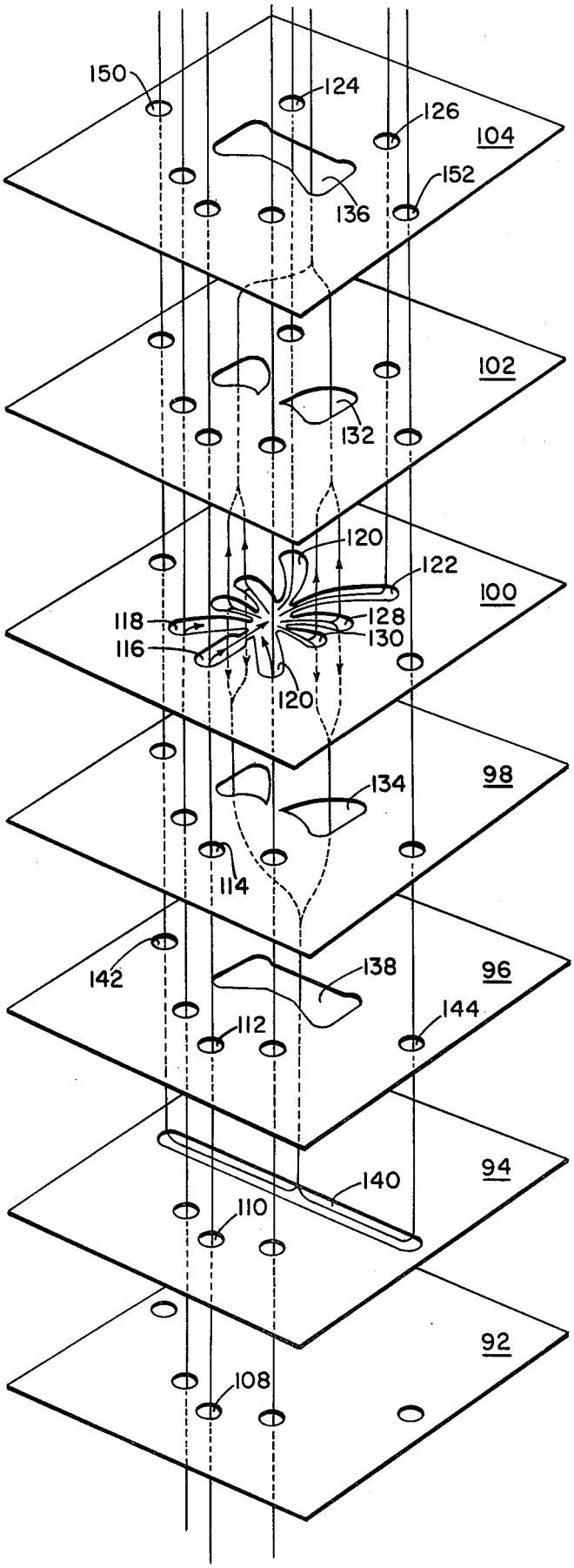
FIG. 4 is an exploded view of a series of laminations embodying a single stage laminar proportional amplifier for assembly with the unit shown in FIG. 3.

FIG. 4 shows a plurality of laminations 92, 94, 96, 98, 100, 102 and 104 that are stacked upon one another in direct contact and in the stated sequence, the lamination 92 being placed upon the top surface 106 of the housing 60. The lamination 92 comprises a base plate. The lamination 94 comprises a manifold. The laminations 96 and 104 comprise sumps. The laminations 98 and 102 comprise vent side connections. The lamination 100 comprises the laminar proportional amplifier. The function and operation of this lamination is identical to that described with reference to FIG. 1.

The pressure applied at the connection 90 (FIG. 3) communicates with the amplifier lamination 100 through perforations 108, 110, 112 and 114 to a perforation 116 forming the source of a laminar jet projected in the direction of the arrows. In a similar manner, the pressures within the pair of input passages 66 and 68 are communicated through perforations in the laminations to the corresponding pair of inlets 118 and 120 in the amplifier 100. In the drawing, the alignment of and fluid communication between the perforations in the respective laminations are illustrated by corresponding flow lines.

Also, in a similar manner perforations 120 and 122 comprising output passages of the amplifier 100 are connected through perforations in the lamination 102 to perforations 124 and 126 in the lamination 104.

It is important that vent pressures of all portions of the laminar proportional amplifier be the same. This is to avoid any deflection of the laminar jet that is not due to the applied control pressure at the inlets 118 and 120. To this end, the amplifier is preferably vented from both the top and the bottom in a symmetrical manner. The lamination 100 has two vent perforations such as 128 and 130 on each side of the laminar jet path. These are interconnected on each side of the lamination 100 by perforations 132 and 134 in the laminations 102 and 98, respectively. Likewise, the vents on both sides of the jet flow path are interconnected by perforations 136 and 138 in the laminations 104 and 96.

Figure 5:
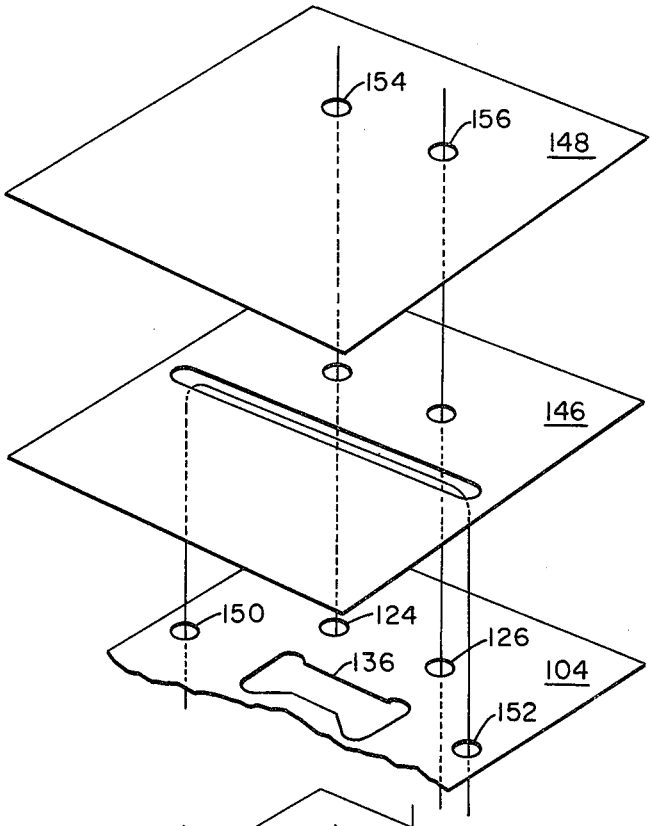
FIG. 5 illustrates the closing laminations for a single stage of amplification.

An elongate perforation 140 in the manifold 94 provides communication between the perforation 138 and perforations such as 142 and 144 that are provided in each of the laminations. If it is desired to have only a single stage of laminar proportional amplification, the unit is completed by providing two additoinal laminations 146 and 148 as shown in FIG. 5. The lamination 146 provides communication between the perforation 136 and perforations such as 150 and 152, and through the latter to a common connection with the perforations 142 and 144. The lamination 148 has only two perforations 154 and 156 leading from the output passages 120 and 122. The manifold lamination 146 thus completes the pressure communication between the vent passages above and below the lamination 100.

Figure 6:
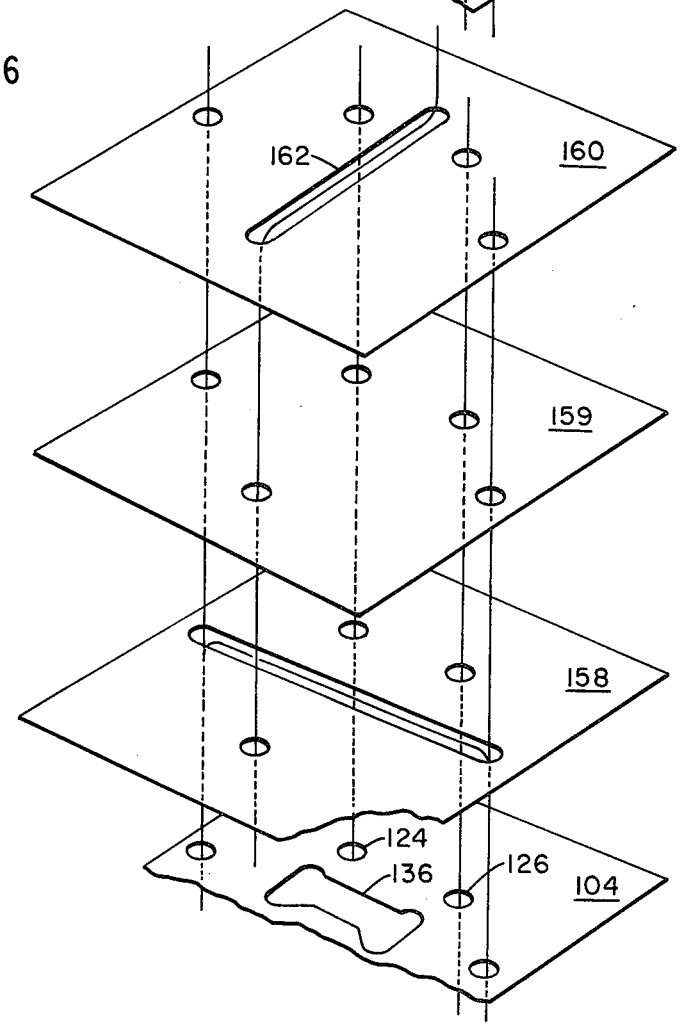
FIG. 6 illustrates the linking laminations for connection between plural stages of amplification.

If a second stage of laminar proportional amplification is desired, linking laminations 158, 159 and 160 are first added to those of FIG. 4, as shown in FIG. 6. The lamination 158 is a manifold lamination functioning to provide pressure communicating between the vent passages above and below the lamination 100 as described above. The lamination 159 provides pressure isolation. The lamination 160 has an elongate perforation 162 that transfers the fluid path from the connection 90 (FIG. 1) to the opposite side of the lamination. A second set of laminations like those shown in FIG. 4 is then added to the lamination 160 but in reverse position so that the ouput passages of the first stage become the input passages to the second stage. Thus the gain is increased. The same technique may be repeated for a greater number of stages, the presently preferred number of stages being four.

In tests, the described embodiment exhibits a number of desirable operating properties. For example, it has a low electrical power consumption, the only power required being that for inducing small movements in the piezoelectric bender 82. Typically, these movements may be in the order of plus or minus 0.0005 inch or less, corresponding to 0.0127 millimeter or less. The device is a high gain, low noise, high bandwidth pneumatic amplifier, and operates as a high speed transducer capable of producing an output substantially proportional to the electrical input voltage. Further, the device has the capability of a DC output. By maintaining the pressure in the region of the nozzles at a sufficiently low level, turbulent and hence noisy pressures at the nozzles and input passages to the laminar porportional amplifier are avoided. Thus the advantages of using a piezoelectric bender element are realized notwithstanding the generally recognized fact that it is a poor force producer, has a very small displacement in response to an applied voltage, and generally exhibits reduced motion in the presence of fluid flow forces.

Figure 3:
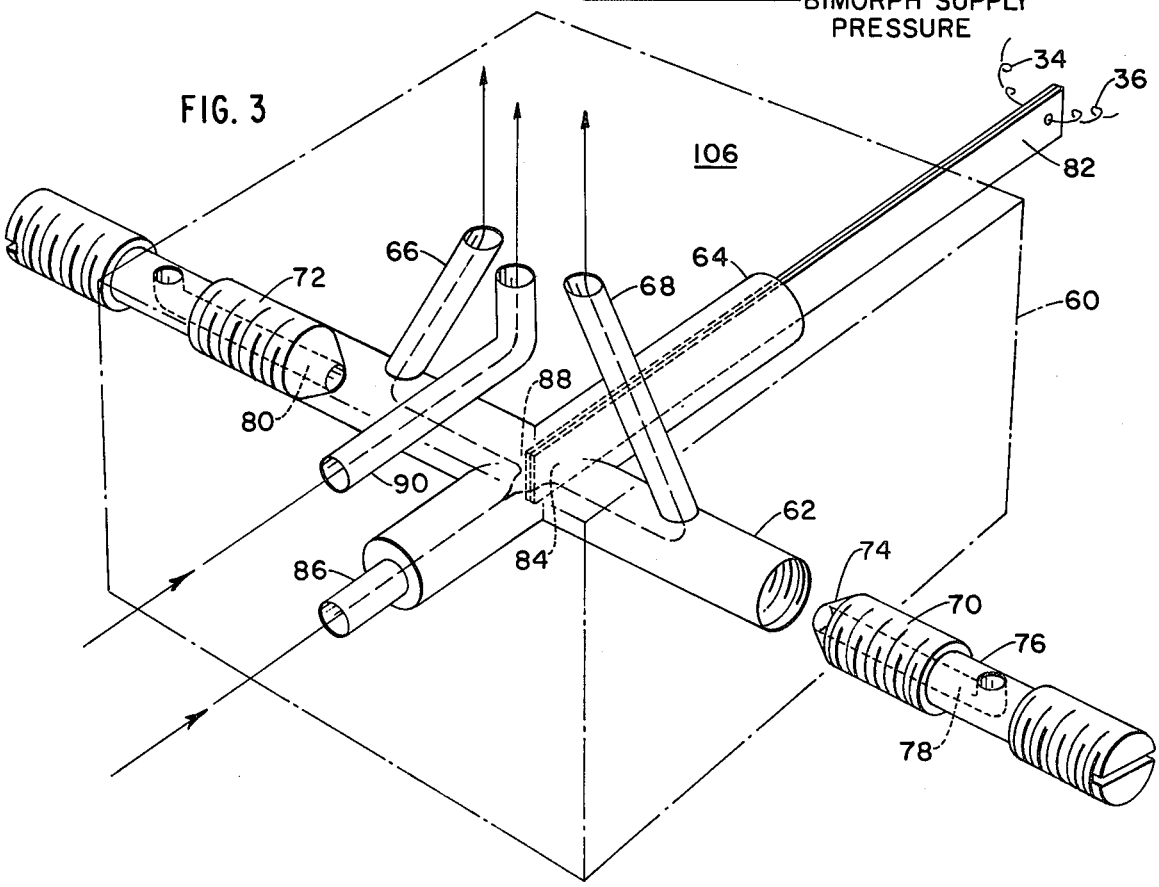
FIG. 3 is an illustration of the part of an illustrative embodiment that incorporates the bender and nozzles.

Pressure measurements were made on the described embodiment of FIGS. 3 and 4 in a configuration having four stages of laminar proportional amplifiers in series connection. The pressure within the bimorph chamber at the intersection of the holes 62 and 64 was about $9.7\times10^{-3}$ psi. The difference between the pressures in the input passages 66 and 68 as measured at their connection to the lamination 92 (FIG. 4) was about $2.4\times10^{-4}$ psi. peak to peak. The difference between the pressures in the output passages as measured at the perforations 154 and 156 of the final laminar proportional amplifier stage was about 0.4 psi. Therefore, the gain of the four stages was about 1650.

We claim:

1. An analog electro-fluidic signal transducer comprising, in combination, a housing defining a first chamber adapted for connection to a first source of fluid pressure, a pair of input passages each having at one end thereof a nozzle open to said chamber, the nozzles being mutually opposed and a predetermined space within said first chamber separating said nozzles, a cantilever mounted piezoelectric bender having a portion thereof located in said predetermined space between the nozzles, said bender being bendable to move said portion toward and away from said nozzles respectively and means for connecting the bender to a voltage source, and a laminar proportional amplifier defining a second chamber, means adapted for connection to a second source of fluid pressure and for directing a laminar jet into the second chamber, a pair of inlets on opposing sides of the jet and connected to said input passages, and a pair of output passages diverging from a flow divider in the path of the jet and downstream of said inlets.

2. The signal transducer of claim 1, in which said portion of the bender is sufficiently close to the nozzles to cause the pressure differential between the input passages to vary as an analog function of a voltage produced by said voltage source.

3. The signal transducer of claim 2, in which the bender and nozzles are mutually spaced so that when said source produces a maximum voltage, the distance from either nozzle to the adjacent surface of the bender does not exceed one-eighth of the nozzle diameter.

4. The signal transducer of claim 1, including a plurality of linear proportional amplifiers, one of said amplifiers having its pair of inlets connected to said input passages and having its pair of output passages connected to the pair of inlets of a second amplifier.

5. The signal transducer of claim 4, in which the second source of fluid pressure is connected to the means for directing a liminar jet in each of the amplifiers.

6. The signal transducer of claim 1, in which the amplifier has vents located laterally of the jet and between the pair of inlets and the flow divider.

7. The signal transducer of claim 4, in which each of the amplifiers has vents located laterally of the jet and between the pair of inlets and the flow divider, the vents of the amplifiers being interconnected.

8. The signal transducer of claim 1, including a pneumatic to electric transducer connected to the pair of output passages and adapted to apply a signal to said voltage source.

9. The signal transducer of claim 4, in which the output passages of an amplifier remote from the housing are connected by feedback passages to the input passages.

10. The signal transducer of claim 1, in which the first source is at a pressure sufficiently low to provide nonturbulent flow to the nozzles, thereby causing the pressure differential between the input passages to vary substantially proportionally to the variations in the voltage of said voltage source.

* * * * *